US006893361B2

(12) United States Patent
Morgan et al.

(10) Patent No.: US 6,893,361 B2
(45) Date of Patent: May 17, 2005

(54) MULTILAYER GOLF BALL WITH HOOP-STRESS LAYER

(75) Inventors: William E. Morgan, Barrington, RI (US); Roman D. Halko, San Diego, CA (US); Emanuel Vieira, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 123 days.

(21) Appl. No.: 10/386,080

(22) Filed: Mar. 12, 2003

(65) Prior Publication Data

US 2003/0166421 A1 Sep. 4, 2003

Related U.S. Application Data

(62) Division of application No. 09/841,910, filed on Apr. 25, 2001, now abandoned.

(51) Int. Cl.[7] ..... A63B 37/04; A63B 37/06; A63B 37/08

(52) U.S. Cl. ..... 473/362; 473/360

(58) Field of Search ..... 473/351, 354, 473/356, 361, 362, 360; 428/407, 423.3

(56) References Cited

U.S. PATENT DOCUMENTS

| | | | | |
|---|---|---|---|---|
| 704,748 | A | 7/1902 | Kempshall | |
| 704,838 | A | 7/1902 | Kempshall | |
| 705,249 | A | 7/1902 | Kempshall | |
| 705,359 | A | 7/1902 | Kempshall | |
| 713,772 | A | 11/1902 | Kempshall | |
| 4,431,193 | A | 2/1984 | Nesbitt | 273/235 |
| 4,473,229 | A | 9/1984 | Kloppenburg et al. | 273/225 |
| 4,938,471 | A | 7/1990 | Nomura et al. | 273/227 |
| 5,150,906 | A | 9/1992 | Molitor et al. | 273/220 |
| 5,334,673 | A | 8/1994 | Wu | 273/235 R |
| 5,480,155 | A | 1/1996 | Molitor et al. | 273/220 |
| 5,484,870 | A | 1/1996 | Wu | 528/28 |
| 5,683,312 | A | 11/1997 | Boehm et al. | 473/354 |
| 5,713,801 | A | 2/1998 | Aoyama | 473/354 |
| 5,913,736 | A | 6/1999 | Maehara et al. | 473/360 |
| 5,919,100 | A | 7/1999 | Boehm et al. | 473/354 |
| 5,944,621 | A | 8/1999 | Tsujinaka et al. | 473/369 |
| 5,993,968 | A | 11/1999 | Umezawa et al. | 428/407 |
| 6,030,296 | A | 2/2000 | Morgan et al. | 473/361 |
| 6,048,279 | A | 4/2000 | Masutani | 473/372 |

OTHER PUBLICATIONS

U.S. Appl. No. 09/741,052, filed Dec. 21, 2000 entitled "Low Modulus Golf Ball Compositions and Methods For Making Same".

R.D. Nesbitt et al., *History and Construction of Non–Wound Golf Balls*, Science and Golf III: Proceedings of the World Scientific Congress of Golf, ed. M.R. Farrally and A.J. Cochran, Scotland, pp. 407–414 (Jul. 1998).

J. Dalton, The Curious Persistence of the Wound Ball, Science and Golf III: Proceedings of the World Scientific Congress of Golf, ed. M.R. Farrally and A.J. Cochran, Scotland, pp. 415–422 (Jul. 1998).

*Primary Examiner*—Glenn Caldarola
*Assistant Examiner*—Tom Duong
(74) *Attorney, Agent, or Firm*—Swidler Berlin Shereff Friedman, LLP

(57) ABSTRACT

The invention includes a golf ball having a center, a hoop-stress layer of high tensile elastic modulus material wrapped or wound about the core, at least one layer of a resilient elastomeric material, and a cover of at least one layer. The center in the golf ball can be a fluid with an encapsulating shell or a solid. A binding material can be used in conjunction with the hoop-stress layer to facilitate positioning of the hoop-stress layer around the center for easier manufacturing.

21 Claims, 3 Drawing Sheets

MULTILAYER GOLF BALL WITH HOOP-STRESS LAYER

This application is a divisional of U.S. patent application Ser. No. 09/841,910, filed Apr. 25, 2001, now abn, now pending, which is incorporated in its entirety by reference herein.

FIELD OF THE INVENTION

This invention relates generally to golf balls, and more specifically, to a golf ball having a hoop-stress layer within a layered construction used to eliminate or substantially inhibit permanent deformation of the ball. In particular, it is directed to a golf ball having at least four layers comprising a core, a hoop-stress layer including at least one material with a tensile elastic modulus of at least about 10,000 kpsi, at least one resilient elastomeric layer, and cover layer. The golf balls of the present invention can provide decreased spin and improved resiliency for better distance.

BACKGROUND OF THE INVENTION

There are many methods for manufacturing golf balls. One type of golf ball includes a tensioned material wound around a spherical center. Another type of golf ball uses solely solid layers, typically of thermoset or thermoplastic materials. Wound balls typically have either a solid rubber or fluid center around which many yards of a tensioned elastic thread, typically polyisoprene, are wrapped to form a wound core. One or more added layers of thermoset or thermoplastic materials may surround the thread layer to complete the golf ball construction. Prior art golf balls with liquid centers have traditionally been enclosed by a layer of wrapped elastic material.

A wound material layer differs from a solid resilient material layer in that the wound layer is often able to more readily elongate and compress in a direction lateral to the impacting force. For this reason, wound golf balls have a tendency to more easily compress at impact as compared to a solid golf ball (Dalton, Golf and Science III, 1999).

It has long been the goal of golf ball manufacturers to create a non-wound construction golf ball with the performance and feel properties of wound balls. Golf ball designs have been introduced which use multilayer non-wound constructions. These include double cover designs with solid, single member cores; dual core designs with two core members and a single cover layer; balls with multiple core and/or multiple cover layers; and balls with liquid centers that do not have elastic windings. U.S. Pat. Nos. 5,480,155 and 5,150,906 by Molitor et al., 5,683,312 and 5,919,100 by Boehm et al. are examples of non-wound liquid center balls. Hollow golf balls having a spherical cavity in the center are disclosed by Boehm et al. and further described in U.S. Pat. No. 5,944,621 to Tsujinaka et al.

One technique suggested in the prior art to avoid the problem of an overly hard stiff cover was disclosed in U.S. Pat. No. 4,431,193 issued to Nesbitt. Rather than have a single layer cover over the core, the cover would be molded in two layers: a hard stiff inner layer of a high flexural modulus material that provides significant hoop stress, surrounded by a soft, flexible outer cover of a lower flexural modulus material. Balls of this design have been sold bearing the Strata name for some time, however, because of the inner layer thickness of about 0.045 inches to 0.050 inches and the high flexural modulus of greater than 50,000 psi, the golf balls have a hard feel to which many golfers object.

U.S. Pat. No. 5,713,801 issued to Aoyama teaches a method for making a golf ball providing a core of solid resilient material, winding a high elastic modulus fiber on the core to create a first wound layer to form a "hoop-stress layer," and molding an outer layer of resilient material about the first wound layer. The invention includes a golf ball having a substantially spherical core, a first wound layer of high tensile elastic modulus fibers wound about the core, and a second molded layer of a resilient material surrounding the wound layer The core in the above method and apparatus may also be made of a center wound with a low modulus fiber and provided with an initial tension.

U.S. Pat. No. 5,913,736 issued to Maehara et al. builds upon Aoyama to describe a hoop-stress layer made of a shape memory alloy (Ti—Ni) wound around a core so as to provide a shaped memory alloy layer.

Thus, it would be advantageous to provide a golf ball having at least four or more layers, including a hoop-stress layer and at least one resilient elastomeric layer, to form a golf ball with improved performance characteristics.

SUMMARY OF THE INVENTION

The present invention is directed to a multilayer golf ball including four or more layers, wherein one of the layers is a hoop-stress layer, including at least one material with a tensile elastic modulus of at least about 10,000 kpsi, located between two of the three innermost layers. Such a golf ball can advantageously provide a softer feel similar to a conventional wound ball, while also providing the low spin rates of a conventional solid composition ball. As discussed in detail below, the multilayer golf ball of the present invention, with a hoop-stress layer, is provided by forming a ball having various structural components (e.g., core, hoop-stress layer, resilient elastomeric layer, and cover) each having desired properties and which may be formed from a variety of materials.

In a first embodiment of the invention, the golf ball includes a fluid-filled center, an encapsulating shell of at least one layer to contain the fluid, a hoop-stress layer including at least one material with a tensile elastic modulus of at least about 10,000 kpsi, preferably 20,000 kpsi, disposed about or within the at least one layer of the encapsulating shell, at least one layer including a resilient elastomeric component disposed about the hoop-stress layer, and a cover including at least one layer disposed about the resilient elastomeric component. Preferably, the hoop-stress layer includes a wire, thread, or filament. In one embodiment, the hoop-stress layer includes glass, aromatic polyamid, carbon, metal, shape memory alloy, natural fiber, or a combination thereof. The hoop-stress layer can be wound or wrapped in a criss-cross, basket weave, or open pattern and include multiple braided elements. In one embodiment, the wire, thread, or filament of the hoop-stress layer is coated with a binding material. In another embodiment, the at least one layer forming the encapsulating shell includes two layers and the material forming the hoop-stress layer is disposed therebetween.

In a second embodiment, the golf ball includes a fluid-filled center, an encapsulating shell of at least one layer to contain the fluid, at least one layer including a first resilient elastomeric component, a hoop-stress layer including at least one material with a tensile elastic modulus of at least about 10,000 kpsi, preferably about 20,000 kpsi, disposed about or within the at least one layer including a first resilient elastomeric component, at least one layer including a second resilient elastomeric component disposed about the hoop-stress layer, and a cover including at least one layer disposed about the at least one layer including a second resilient elastomeric component. Preferably, the hoop-stress layer includes a wire, thread, or filament. In one embodiment, the material forming the hoop-stress layer includes glass, aromatic polyamid, carbon, metal, shape memory alloy, natural fiber, or a combination thereof The hoop-stress layer can be wound or wrapped in a criss-cross, basket weave, or open pattern and include multiple braided elements. In one embodiment, the wire, thread, or filament of the hoop-stress layer is coated with a binding material. In another embodiment, the first and second resilient elastomeric components are the same. Yet in another embodiment, the first and second resilient elastomeric components are different from each other.

In a third embodiment of the invention, the golf ball includes at least one core layer including a first resilient elastomeric component, a hoop-stress layer including at least one material with a tensile elastic modulus of at least about 10,000 kpsi, preferably about 20,000 kpsi, wound about or embedded within the surface of the at least one core layer, at least one intermediate layer of a second resilient elastomeric component disposed about the hoop-stress layer; and a cover of at least one layer disposed about the at least one intermediate layer. Preferably, the hoop-stress layer includes a wire, thread, or filament made of glass, aromatic polyamid, carbon, metal, shape memory alloy, natural fiber, or a combination thereof. The hoop-stress layer can be wound or wrapped in a criss-cross, basket weave, or open pattern and include multiple braided elements. In one embodiment, the wire, thread, or filament of the hoop-stress layer is coated with a binding material. In another embodiment, the first and second resilient elastomeric components are the same. Yet in another embodiment, the first and second resilient elastomeric components differ. In one embodiment, the first resilient elastomeric component has a compression of greater than about 50.

A fourth embodiment of the invention includes a golf ball with a center, a cover of at least one layer, and a hoop-stress layer including at least one material with a tensile elastic modulus of at least about 10,000 kpsi, preferably about 20,000 kpsi, located between two of the three innermost layers, wherein the material has a first cross-sectional area and the material is coated in a binding material to create a second cross-sectional area greater than the first. The center can be solid or fluid-filled with a diameter from about 0.5 inch to 1.55 inches, preferably from about 1.1 inches to 1.5 inches. In one preferred embodiment, the center is surrounded by an additional surrounding elastic wound layer. The hoop-stress layer can include a continuous strand having a diameter from about 0.004 to 0.04 inches. Preferably, the binding material coats the wire, thread, or filament of the hoop-stress layer so that the second cross-sectional area is at least about 5 percent larger than the first cross-sectional area. The binding material can include thermoplastic polyvinyl butyral, thermoplastic epoxy, thermoplastic polyester phenolic, thermoplastic polyamide, thermosetting adhesive epoxy, thermoplastic polyamide-imide, or combinations thereof In one embodiment, the cover material has a hardness of less than about 75 Shore D , and in another embodiment, the materials has a hardness less than about 65 Shore D.

BRIEF DESCRIPTION OF THE DRAWINGS

Further features and advantages of the invention can be ascertained from the following detailed description which is provided in connection with the attached drawings, wherein.

DEFINITIONS

Figure 1:
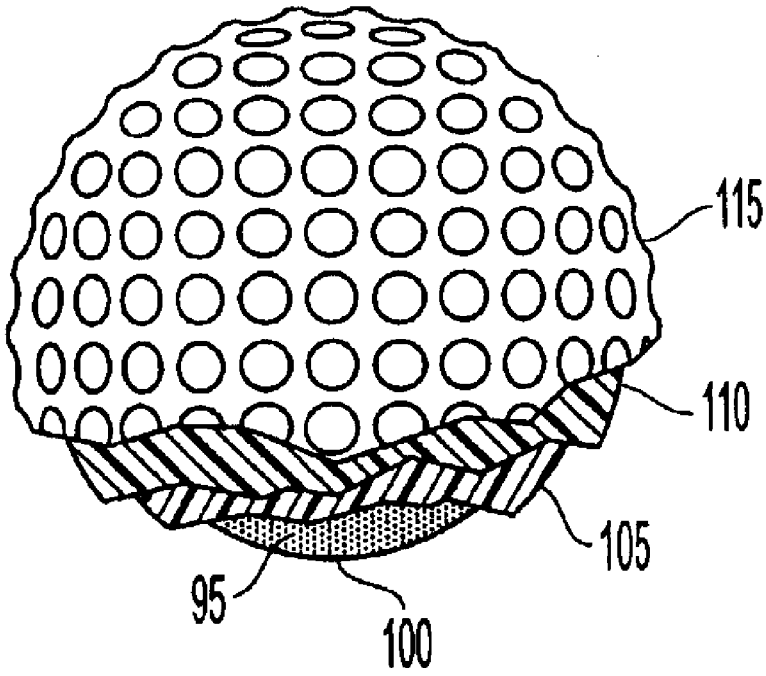
FIG. 1 illustrates a cut-away view of a multilayer non-wound golf ball with a hoop-stress layer in accordance with the present invention.

The term "about," as used herein in connection with one or more numbers or numerical ranges, should be understood to refer to all such numbers, including all numbers in a range.

As used herein, the term "fluid" includes a liquid, a paste, a gel, a gas (including air, regardless of pressure) or any combination thereof.

As used herein, the term "multilayer" means at least four layers and includes fluid-center balls, wound balls, hollow-center balls, and balls with at least two intermediate layers and/or cover layers.

As used herein, "cis-to-trans catalyst," means any component or a combination thereof that will convert at least a portion of cis-isomers to trans-isomers of polybutadiene at a given temperature.

As used herein, the term "parts per hundred", also known as "phr", is defined as the number of parts by weight of a particular component present in a mixture, relative to 100 parts by weight of the total polymer component. Mathematically, this can be expressed as the weight of an ingredient divided by the total weight of the polymer, multiplied by a factor of 100.

As used herein, the term "molecular weight" is defined as the absolute weight average molecular weight. The molecular weight is determined by the following method: approximately 20 mg of polymer is dissolved in 10 mL of tetrahydrofuran ("THF"), which may take a few days at room temperature depending on the polymer's molecular weight and distribution. One liter of THF is filtered and degassed before being placed in a high-performance liquid chromatography ("HPLC") reservoir. The flow rate of the HPLC is set to 1 mL/min through a Viscogel column. This non-shedding, mixed bed, column model GMHHR-H, which has an ID of 7.8 mm and 300 mm long is available from Viscotek Corp. of Houston, Tex. The THF flow rate is set to 1 mL/min for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment. A 100-$\mu$L aliquot of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein.

DETAILED DESCRIPTION OF THE INVENTION

It has now been discovered that the use of a plurality of resilient elastomeric layers in combination with a wound or wrapped hoop-stress layer providing the necessary hoop-stress, in forming golf balls, according to the present invention, can advantageously provide desirable performance improvements in a golf ball.

The present invention advantageously allows the center components, i.e., solids or fluids, to return to shape post-impact, thus avoiding permanent deformation, with a different approach, that of providing several intermediate layers, including a hoop-stress layer disposed between the center and cover of the golf ball. The hoop-stress layer is formed of a wound, high tensile elastic modulus material, such as a thread, fiber, filament, or wire. This wound high tensile elastic modulus layer can be incorporated within one or more layers of a multilayer center, particularly when the innermost member is a fluid. The hoop-stress layer does not need to be applied directly to the center, but can be wound about any layer between the center and the outermost cover layer. The hoop-stress layer can be incorporated within one or more layers of a solid multilayer center, wherein the innermost layer(s) of the center are subject to high deflections upon impact with a golf club. In addition, a binding material can coat the hoop-stress layer so that the layer will remain properly positioned around the center or core of the golf ball.

The golf ball of the invention is believed to provide a further benefit for a golfer's short game. The spin of a ball after being struck with a large force, such as with a driver, is controlled by the relationship between the softness (flexibility) of the cover and the compressibility of the center of the golf ball. When the impact force is low, such as in the short game, the resulting spin of a golf ball is controlled almost entirely by surface (cover) hardness. A softer cover is desired by golfers to improve short game spin, however, it also increases driver spin and decreases distance. To some extent, softening the center can reduce the driver spin of soft-covered balls, but if both the cover and the core are too soft, the golf ball loses resiliency and the resulting initial velocity and distance that are also desired in a golf ball. Therefore, golf ball manufacturers are challenged with making a soft cover golf ball with low driver spin, which the present invention advantageously provides.

Thus, improved golf balls can be prepared according to the invention by: (a) providing a center; (b) winding or wrapping a hoop-stress layer of high tensile elastic modulus material about the center, optionally with one or more layers disposed therebetween; (c) surrounding the hoop-stress layer with at least one layer formed including a resilient elastomeric component; and (d) disposing a cover including at least one layer.

In FIG. 1, a golf ball center 95 is surrounded by a hoop-stress layer 105 of high tensile elastic modulus of at least 10,000 kpsi with one or more layers 100 disposed therebetween. This hoop-stress layer is surrounded by at least one layer including a resilient elastomeric component 110. A cover 115 of at least one layer surrounds the resilient elastomeric layer 110.

Figure 2:
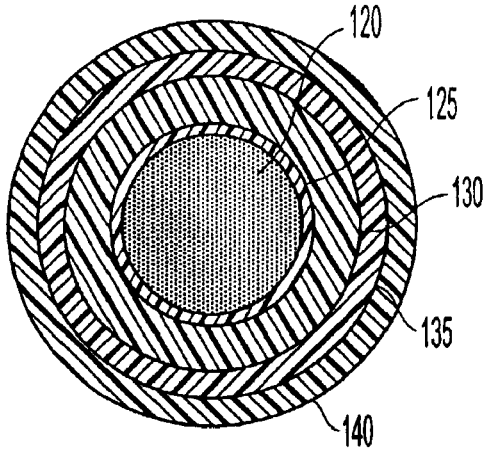
FIG. 2 illustrates a cross-section of a multilayer non-wound fluid center golf ball with a hoop-stress layer and at least one resilient elastomeric layer in accordance with one embodiment of the present invention.

In one embodiment, shown in FIG. 2, the golf ball of the invention has a fluid center 120 surrounded by an encapsulating shell 125 of at least one layer. The hoop-stress layer 130 is preferably wound or wrapped around the encapsulating shell 125 or, in an embodiment not shown, the encapsulating shell 125 is made up of multiple layers and the the hoop-stress layer is disposed therebetween. Hoop-stress layer 130 has the characteristics described herein. At least one layer comprising a resilient elastomeric component 135 surrounds the hoop-stress layer 130 and preferably has at least one layer that is a solid. A cover 140, of one or more layers optionally, but preferably, surrounds layer 135.

Figure 3:
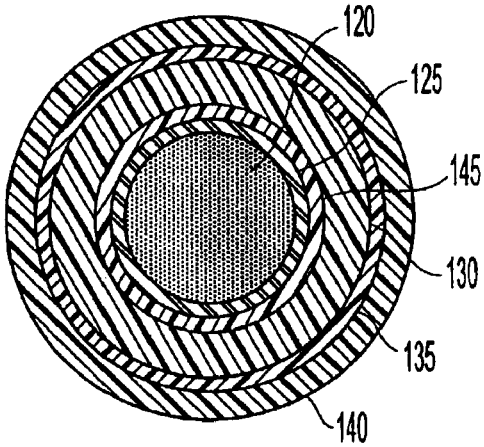
FIG. 3 illustrates a cross-section of a multilayer non-wound fluid center golf ball with a hoop-stress layer and a plurality of resilient elastomeric layers in accordance with the second embodiment of the present invention.

In a second embodiment shown in FIG. 3, a golf ball including a fluid center is contained by an encapsulating shell, a first resilient elastomeric layer, a hoop-stress layer, a second resilient elastomeric layer, and a cover. The plurality of layers can decrease or eliminate permanent ball deformation without adversely increasing the hardness of the ball or its components. An encapsulating shell 125 of at least one layer contains the fluid center 120. A first resilient elastomeric material 145 of at least one layer surrounds the encapsulating shell 125 and fluid center 120. The hoop-stress layer 130 is preferably wound or wrapped around the first resilient elastomeric layer 145 or, in one embodiment (not shown) the first resilient elastomeric component 145 includes more than one layer and the hoop-stress layer is disposed therebetween. A second resilient elastomeric component 135 of at least one layer surrounds the hoop-stress layer 130. A cover 140 of one or more layers can be formed around the second resilient elastomeric layer 135. The components forming the first and second resilient elastomeric layers need not necessarily be the same, but in one embodiment, the components have the same characteristics.

Figure 4:
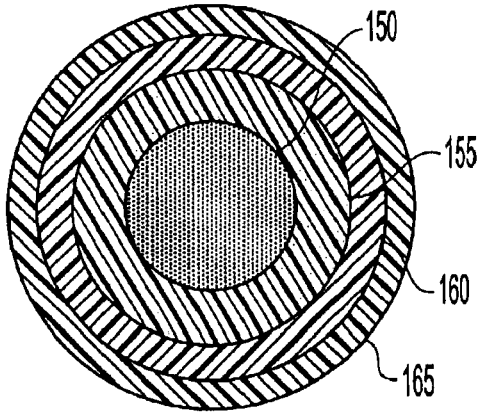
FIG. 4 illustrates a cross-section of a multilayer non-wound solid center golf ball with a hoop-stress layer in accordance with the third embodiment of the present invention.

A third embodiment of the invention is shown in FIG. 4 relating to a golf ball with at least four layers including a solid center and a hoop-stress layer. Such a golf ball can provide good short-game spin, and the resulting ability to better control the golf ball in and around the green, without adversely impacting other characteristics in an undesirable fashion. The center of the golf ball is made of a first resilient elastomeric material 150 surrounded by a hoop-stress layer 155 of high tensile elastic modulus material. Center layer 150 includes at least one layer and preferably has at least one of the layers being a solid material. A second resilient elastomeric component 160 encases the hoop-stress layer. A cover 165 of one or more layers can surround resilient elastomeric material 160.

Figure 5:
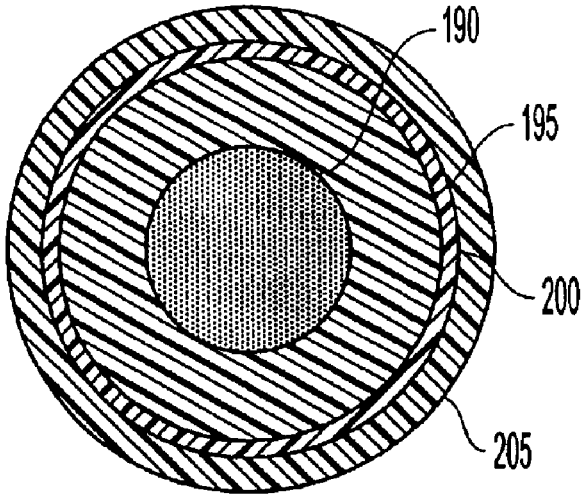
FIG. 5 illustrates a cross-section of a multilayer golf ball with a hoop-stress layer coated with a binding material in accordance with the fourth embodiment of the present invention.

In the fourth embodiment of the invention, the wire, thread, or filament of the hoop-stress layer is coated with a binding material to create a low spin, highly resilient multilayer golf ball. The binding material surrounding the hoop-stress layer advantageously ensures the hoop-stress layer repeatable proper positioning around the center during manufacturing. FIG. 5 shows a center 190 surrounded by a hoop-stress layer 195. The center can be a fluid or a solid. If the center is fluid, an encapsulating shell of at least one layer surrounds the center and the hoop-stress layer would then surround the encapsulating shell or be sufficiently embedded within one or more layers of the encapsulating shell. The center preferably has a diameter ranging from about 1 inch to about 1.59 inches. More preferably, the diameter of the center ranges from about 1.2 inches to about 1.4 inches. In one preferred embodiment (not shown), an elastic wound layer can be placed within the center 190 and the hoop-stress layer 195. The hoop-stress layer 195 is preferably made of a continuous single strand with a diameter ranging from about 0.004 inches to about 0.02 inches and preferably includes a high specific gravity alloy, preferably steel, brass, or bronze.

The wire, thread or filament of hoop-stress layer 195 is coated with a binding material 200 that will adhere to the center and itself when activated. The cover 205 surrounds the inner layers of the ball and can be made of at least one layer of any suitable thermoset or thermoplastic material available to one of ordinary skill in the art. In one embodiment, the cover material preferably has a hardness of less than about 75 Shore D. In another embodiment, the cover material has a hardness of less than about 65 Shore D.

The Centers

The centers employed in the golf balls of the present invention preferably have a diameter of about 0.5 inches to about 1.6 inches, more preferably about 1.1 inches to about 1.5 inches.

If the center of a golf ball is fluid with a rigid solid member surrounding the center, such a construction is likely to affect overall performance of the golf ball as if it were a hard center with a flexural modulus of greater than about 50,000 psi. Hard center properties increase golf ball spin, thus hindering the purpose of fluid center. Therefore, in other embodiments of the invention shown in FIG. 2, FIG. 3, and FIG. 5, the encapsulating shell used to help retain the fluid must be sufficiently flexible, i.e., have a flexural modulus less than about 50,000 psi, to allow the center of the ball to promote decreased spin while still returning rapidly to its original shape post-impact.

In one embodiment, shown in FIG. 4, center is solid and has the characteristics of the resilient elastomeric components described herein, and is preferably polybutadiene. In one embodiment, the center has a compression of greater than about 50.

Many golf balls use fillers added to the elastomeric composition in the cores to adjust the density and/or specific gravity of the core. In a preferred embodiment, the golf balls of the present invention use little filler, if any. As used herein, the term "fillers" includes any compound or composition that can be used to vary the density and other properties of a layer or portion of a golf ball. If needed, fillers useful in the golf ball according to the present invention include, for example, precipitated hydrated silica; clay; talc; asbestos; glass fibers; aramid fibers; mica; calcium metasilicate; barium sulfate; zinc sulfide; lithopone; silicates; silicon carbide; diatomaceous earth; carbonates such as calcium carbonate and magnesium carbonate; metals such as titanium, tungsten (e.g., powdered), lead, aluminum, bismuth, nickel, molybdenum, iron, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof. The amount and type of filler utilized is governed by the amount and weight of other ingredients in the composition, since a maximum golf ball weight of 45.93 g (1.62 ounces) has been established by the United States Golf Association (USGA). Appropriate fillers generally used have a specific gravity from about 2 to 20. In one preferred embodiment, a filler having a specific gravity of about 12 to 20 can be included.

The Encapsulating Shell

Any suitable shell material, or blend thereof, capable of inhibiting or preventing fluid loss from the ball available to those of ordinary skill in the art may be used to form the encapsulating shells of the present invention.

Exemplary materials for use in the shell include thermoset or thermoplastic materials; including polyisoprene; natural rubber; a polyether-ester copolymer; castable thermoset urethanes; vinyl resins, such as those formed from polymerization of vinyl chloride or from copolymerization of vinyl chloride with vinyl acetate, acrylic esters, or vinylidene chloride; polyolefins, such as polyethylene, polypropylene, polybutylene, and copolymers such as polyethylene methacrylate, polyethylene vinyl acetate, polyethylene methacrylic or acrylic acid, polypropylene acrylic acid, or terpolymers thereof with acrylate esters and their metal ionomers; polyamides, such as poly (hexamethylene adipamide) or others prepared from diamines and dibasic acids, poly(caprolactam), PEBAX, a poly(etheramide) block copolymer commercially available from Elf Atochem having an address in Philadelphia, Pa., and blends of polyamides with SURLYN, polyethylene or copolymers thereof, EPDM; acrylic resins; thermoplastic rubbers, such as urethanes, olefinic thermoplastic rubbers such as styrene and butadiene block copolymers or isoprene or ethylene-butylene rubber; polyphenylene oxide resins or blends thereof with polystyrene; thermoplastic polyesters, such as PET, PBT, PETG, and elastomers such as HYTREL, which is commercially available from E.I. DuPont De Nemours & Company of Wilmington, Del.; blends and alloys including polycarbonate with ABS, PBT, PET, SMA, PE elastomers, and PVC with ABS or EVA or other elastomers; blends of thermoplastic rubbers with polyethylene, polypropylene, polyacetal, nylon, polyesters, cellulose esters; metallocene catalyzed polyolefins; silicone; polybutylene terephthalate; or the like; or any combination thereof.

The encapsulating shells employed in the golf balls of the present invention preferably have a thickness from about 0.01 inches to 0.12 inches, more preferably about 0.04 inches to 0.09 inches. In one preferred embodiment, the encapsulating shell thickness is about 0.03 inches. The outer diameter of the encapsulating shell is preferably from about 1 to about 1.5 inches.

The Hoop-Stress Layer

The hoop-stress layer of the present invention has a tensile modulus of at least about 10,000 kpsi and is formed of a high tensile "filament" which can be a thread, filament, or wire, preferably glass, aromatic polyamids, carbon, metals, shape memory alloys, or natural fibers, or a combination or blend thereof. The hoop-stress layer is wound or wrapped about the core of one or more layers. In a more preferred embodiment, the wound layer has a tensile modulus of at least about 20,000 kpsi. If a wound layer is created using a high density material, such as a metal, the ball will have an increased moment of inertia, and thus will tend to spin less when struck with a golf club and yet retain its spin longer during flight. The use of high density materials in the hoop-stress layer can advantageously permit the fillers from other components of the golf ball to be reduced or removed while keeping the overall golf ball weight constant. Specifically, removing fillers from elastomeric components such as the resilient elastomeric material used as another layer of the ball can soften and increase resilience of the components and even the ball.

Any suitable winding or wrapping method known to those of ordinary skill in the art can be used to form the hoop-stress layer. Preferably, the hoop-stress layer is created winding strands in a criss-cross, basket weave, or open pattern, which requires fewer wraps than a great circle pattern and a less dense application to obtain spherical symmetry. The criss-cross pattern typically employs a fairly large lateral rotation during winding. One such suitable method is described in U.S. Pat. No. 4,938,471 to Nomura et al., wherein at least 8 turns of every ten turns of strands around the center have a crossing angle between two consecutive turns in the range of 12° to 45°. The hoop-stress layer can include multiple strands that are braided, or otherwise entwined, during the winding or wrapping process.

In one embodiment, a binding material preferably coats the material having a first cross-sectional area which forms the hoop-stress layer, to create a second cross-sectional area greater than the first. The binding material preferably causes the strands of the hoop-stress layer to swell so as to increase the cross-sectional area of each strand. This can advantageously permit repeatable proper positioning of the hoop-stress layer around the center or core of the golf ball. In a preferred embodiment, the binding material increases the cross-sectional area of the hoop-stress layer by at least about five (5) percent. In a preferred embodiment, the cross-sectional area can be increased by at least about ten (10) percent.

The binding material can include one or more thermoplastic or thermoset materials. Thermoplastics can become tacky upon heating thus improving adhesion within the hoop-stress layer or even fully melt to fuse with some or all of the hoop-stress layer. A thermoplastic component might also include a blowing agent to create a foamed structure within the hoop-stress layer. Examples of thermoplastics useful in the binding material include thermoplastic polyvinyl butyral, thermoplastic epoxy, thermoplastic polyester phenolic, thermoplastic polyamide, thermoplastic polyamide-imide, or a combinations thereof. A thermoset material, such as thermosetting adhesive epoxy, may alternatively respond to an elevated temperature to promote intra- and/or inter- layer adhesion and cause the hoop-stress layer to swell.

The binding material can be activated, for example, by heat, pressure, chemical or photo-activation, before, during, or after the winding process.

The hoop-stress layer can include one or more strands, but is preferably made of a single continuous strand with a diameter ranging from about 0.004 inches to 0.04 inches. The material forming the hoop-stress layer preferably includes one or more high specific gravity alloys.

Examples of suitable high specific gravity alloys are alloys that have specific gravities greater than about 7.6, which include steel, brass, bronze, copper, nickel, lead, titanium, gold, silver, and platinum. Exemplary alloys include steel, brass, and bronze as they provide the best combination of tensile strength (greater than about 250 $N/mm^2$) and high specific gravity (ranging from about 7.6 to about 9). While gold, silver, and platinum have higher specific gravities than other suitable alloys, they tend to be expensive; copper and nickel have similar specific gravities as the exemplary alloys, but do not tend to provide comparable strength; and titanium is strong, but tend to have a lower specific gravity than steel.

The hoop-stress layers employed in the golf balls of the present invention preferably have a thickness from about 0.01 inches to 0.1 inches, more preferably about 0.02 inches to 0.08 inches. In one exemplary embodiment, the hoop-stress layer has a thickness of about 0.04 inches. The outer diameter of the hoop-stress layer is preferably from about 1.3 to about 1.63 inches.

The Resilient Elastomeric Layer(s)

A representative base composition for forming a resilient elastomeric material includes polybutadiene and, in parts by weight based on 100 parts polybutadiene. In a preferred embodiment, the composition also includes 20 to 50 parts of a metal salt diacrylate, dimethacrylate, or monomethacrylate, preferably zinc diacrylate. The polybutadiene preferably has a cis 1,4 content of above about 90% and more preferably above about 96%.

Preferred commercial sources of polybutadiene include Shell 1220 manufactured by Shell Chemical, Neocis BR40 and BR60 manufactured by Enichem Elastomers, Ubepol BR 150 and 360 manufactured by Ube Industries, Ltd., CB23 manufactured by Bayer AG, and BUDENE 1207G, manufactured by Goodyear. If desired, the polybutadiene can also be mixed with other elastomers known in the art, such as natural rubber, styrene butadiene, and/or isoprene in order to further modify the properties of the material. When a mixture of elastomers is used, the amounts of other constituents in the core composition are generally based on 100 parts by weight of the total elastomer mixture.

Also, the resilient elastomeric layer may include a resilient controlled-isomer polybutadiene polymer that typically includes at least about 10 percent up to 80 percent trans-isomer content with the rest being cis-isomer and vinyl-isomer distributed randomly, pseudo-randomly, or in block fashion along the same polybutadiene backbone. Such materials are disclosed in U.S. patent application Ser. No. 09/741,052, filed Dec. 21, 2000, which is incorporated by reference herein.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity in the USGA test. The zinc diacrylate can be of various grades of purity. For the purposes of this invention, the lower the quantity of zinc stearate present in the zinc diacrylate the higher the zinc diacrylate purity. Zinc diacrylate containing about 1 to 10 percent zinc stearate is preferable. In one embodiment, it is more preferable to use zinc diacrylate containing about 4 to 8 percent zinc stearate. Suitable commercially available zinc diacrylates include those from Rockland React-Rite, Inc. of Rockmart, Ga. and Sartomer Co., Inc. of Exton, Pa. The preferred concentrations of zinc diacrylate that can be used are about 20 phr to 50 phr based upon 100 parts of polybutadiene or alternately, polybutadiene with a mixture of other elastomers.

Free radical initiators are used to promote cross-linking of the metal salt diacrylate, dimethacrylate, or monomethacrylate and the polybutadiene. Any suitable free radical initiators can be used in the invention. Exemplary initiators include, but are not limited to, peroxide compounds. Exemplary peroxides include dicumyl peroxide, 1,1-di (tbutylperoxy) 3,3,5-trimethyl cyclohexane, a-a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100 percent activity are preferably added in an amount ranging between about 0.05 and 2.5 phr based upon 100 parts of butadiene, or butadiene mixed with one or more other elastomers. More preferably, the amount of initiator added ranges between about 0.15 and 2 phr and most preferably between about 0.25 phr and 1.5 phr.

In one embodiment, the resilience index of the core is greater than about 40, preferably greater than about 45. In one preferred embodiment, the resilience index of the core is greater than about 50. The core compression can thus be reduced, thereby decreasing the overall spin rate of the ball without a significant loss in golf ball initial velocity. An exemplary finished ball velocity according to the present invention can advantageously be about 253.5 to 254.5 ft/s. These correspond to CORs of 0.812 and 0.818 respectively. Polymers that produce resilient cores include, but are not limited to, CB23, BR60, or a blend thereof. CB23 is commercially available from Bayer Corporation of Akron, Ohio.

The resilient elastomeric material may have a molecular weight of greater than about 200,000, and in one embodiment, preferably greater than about 300,000. More preferably, the molecular weight of the rubber material of the resilient elastomeric layer is greater than about 350,000.

Each layer that includes a resilient elastomeric component can be the same or different from any other resilient elastomeric layers in the golf ball.

The Cover

Any number of a wide variety of cover materials may be used in the present invention such as ionomer resins, polyurethanes, balata and blends thereof, with ionomer resins being preferred (such as the variety of ionomers sold by the DuPont Chemical Company under the trade name of "Surlyn"), all of which are well known to those of ordinary skill in the art. The cover of the present invention include at least one layer, preferably of a thermoplastic or thermosetting material.

The cover layer, which may include an inner and outer cover layer, can each include any materials known to those of ordinary skill in the art, including thermoplastic and thermosetting materials, but preferably the inner cover layer can include any suitable materials, such as ionic copolymers of ethylene and an unsaturated monocarboxylic acid which are available under the trademark SURLYN of E.I. DuPont de Nemours & Co., of Wilmington, Del., or IOTEK or ESCOR of Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

This golf ball can likewise include one or more homopolymeric or copolymeric materials, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;

(3) Polyurethanes, such as those prepared from polyols and diisocyanates or polyisocyanates and those disclosed in U.S. Pat. No. 5,334,673;

(4) Polyureas, such as those disclosed in U.S. Pat. No. 5,484,870;

(5) Polyamides, such as poly(hexamethylene adipamide) and others prepared from diamines and dibasic acids, as well as those from amino acids such as poly (caprolactam), and blends of polyamides with SURLYN, polyethylene, ethylene copolymers, ethylpropylene-non-conjugated diene terpolymer, and the like;

(6) Acrylic resins and blends of these resins with poly vinyl chloride, elastomers, and the like;

(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by Atofina of Philadelphia, Pa. (formerly Elf Atochem);

(8) Polyphenylene oxide resins or blends of polyphenylene oxide with high impact polystyrene as sold under the trademark NORYL by General Electric Company of Pittsfield, Mass.;

(9) Thermoplastic polyesters, such as polyethylene terephthalate, polybutylene terephthalate, polyethylene terephthalate/glycol modified and elastomers sold under the trademarks HYTREL by E.I. DuPont de Nemours & Co. of Wilmington, Del., and LOMOD by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

The covers employed in the golf balls of the present invention preferably have a thickness from about 0.02 inches to 0.1 inches. More preferably, the cover has a thickness of about 0.04 inches to 0.085 inches, preferably about 0.04 inches to 0.065 inches.

The cover layer is formed preferably by injection or compression molding, reaction injection molding, casting, or another process(es) well known to those of ordinary skill in the art of manufacturing golf balls.

The multilayer golf ball of the invention can have an overall diameter of any size. Although the United States Golf Association specifications limit the minimum size of a competition golf ball to 1.68 inches in diameter or more, there is no specification as to the maximum diameter. Moreover, golf balls of any size can be used for recreational play. The preferred diameter of the present golf balls is from about 1.68 inches to 1.8 inches. The more preferred diameter is from about 1.68 inches to 1.76 inches. The most preferred diameter is about 1.68 inches to 1.7 inches.

It is to be understood that the invention is not to be limited to the exact configuration as illustrated and described herein. For example, it should be apparent that a variety of materials would be suitable for use in the composition or method of making the golf ball according to the Detailed Description. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A method of making a golf ball, comprising the steps of:

providing an encapsulating shell;

filling the encapsulating shell with a fluid;

providing a hoop-stress material having a tensile elastic modulus of about 10,000 kpsi or greater and a cross-sectional area;

coating the hoop-stress material with a binding material to create a coated hoop-stress material;

wrapping the coated hoop-stress material about the encapsulating shell to create an inner ball;

forming a layer disposed about the inner ball; and forming a cover about the layer.

2. The method of claim 1, wherein the step of forming a layer comprise the steps of:

providing a resilient elastomeric material; and forming the layer comprising the resilient elastomeric material.

3. The method of claim 1, wherein the step of providing an encapsulating shell comprises forming an encapsulating shell having a thickness of about 0.04 inches to about 0.09 inches.

4. The method of claim 1, wherein the step of coating the hoop-stress material further comprises the step of:

activating the binding material by heat activating, pressure activating, chemical activating, photo activating, or a combination thereof.

5. The method of claim 4, wherein the step of activating increases the cross-sectional area by about 5 percent or greater.

6. The method of claim 1, wherein the step of providing a hoop-stress material comprises selecting a continuous strand having a diameter of about 0.004 inches to about 0.04 inches.

7. The method of claim 1, wherein the step of providing a hoop-stress material comprises selecting a material having a specific gravity of greater than about 6.

8. The method of claim 1, wherein the step of forming a cover comprises the step of:

providing a cover material comprising ionomer resin, polyurethane, polyurea, or mixtures thereof; and forming the cover material about the layer by compression molding, injection molding, reaction injection molding, casting, or combinations thereof.

9. A method of making a golf ball, comprising the steps of:

providing a core;

providing a continuous strand having a tensile elastic modulus of about 10,000 kpsi or greater and a first cross-sectional area;

coating the continuous strand with a binding material;

activating the binding material to create a coated strand having a second cross-sectional area larger than the first cross-sectional area by about 5 percent or greater;

wrapping the coated strand about the core;

forming a layer comprising a first resilient elastomeric material; and forming a cover about the layer.

10. The method of claim 9, wherein the step of coating the continuous strand further comprises the step of:

providing a binding material selected from the group consisting of thermoplastic polyvinyl butyral, thermoplastic epoxy, thermoplastic polyester phenolic, thermoplastic polyamide, thermosetting adhesive epoxy, thermoplastic polyamide-imide, and combinations thereof.

11. The method of claim 9, wherein the step of activating produces a second cross-sectional area larger than first cross-sectional area by about 10 percent or greater.

12. The method of claim 9, wherein the step of providing a core comprises the step of:

providing a second resilient elastomeric component; and forming the second resilient elastomeric component into a core.

13. The method of claim 12, wherein the first resilient elastomeric component and the second resilient component are the same.

14. The method of claim 12, wherein the first resilient elastomeric component and the second resilient component differ.

15. The method of claim 9, wherein the step of wrapping comprises winding the hoop-stress material in a criss-cross pattern, a basket weave pattern, an open pattern, or a combination thereof.

16. A method of making a golf ball, comprising the step of:

providing a fluid-filled center encapsulated by a shell to create a core;

forming a first layer disposed about the core comprising a first resilient elastomeric material;

providing hoop-stress material having a tensile elastic modulus of about 10.000 kpsi or greater and a cross-sectional area;

coating the hoop-stress material with a binding material to increase the cross-sectional area by about 5 percent or greater;

wrapping the hoop-stress material about the core to create an inner ball;

forming a second layer comprising a second resilient elastomeric material about the inner ball; and forming a cover about the second layer.

17. The method of claim 16, wherein the hoop-stress material has a tensile elastic modulus of about 20,000 kpsi or greater.

18. The method of claim 16, wherein the step of providing a hoop-stress material comprises selecting the hoop-stress material from the group consisting of glass, aromatic polyamide, carbon, metal, shape memory alloy, natural fiber, and mixtures thereof.

19. The method of claim 16, wherein the step of coating further comprises activating the binding material by heat, pressure, chemical activation, photo activation, or a combination thereof.

20. The method of claim 16, wherein the step of forming a cover comprises compression molding, injection molding, reaction injection molding, casting, or a combination thereof.

21. The method of claim 16, wherein the first resilient elastomeric material and the second resilient elastomeric material differ.

* * * * *